United States Patent [19]

Fukushima et al.

[11] 4,403,863

[45] Sep. 13, 1983

[54] METHOD FOR PREPARING CONCRETE BY USE OF MULTI-LAYER PAN TYPE MIXER

[75] Inventors: Takeshi Fukushima, Ichikawashi; Kiyoshi Sakagami, Funabashishi; Yoshihiro Ikegami, Chibashi, all of Japan

[73] Assignee: Pacific Metals, Co., Ltd., Tokyo, Japan

[21] Appl. No.: 281,897

[22] Filed: Jul. 9, 1981

[30] Foreign Application Priority Data

Jul. 12, 1980 [JP] Japan ..... 55-95261

[51] Int. Cl.[3] ..... B28C 5/16; B28C 7/04

[52] U.S. Cl. ..... 366/8; 366/15; 366/19; 366/40; 366/65; 366/67

[58] Field of Search ..... 366/3, 6, 8, 14, 15, 366/16, 19, 34, 37, 40, 65, 67, 154, 290

[56] References Cited

U.S. PATENT DOCUMENTS

| | | | |
|---|---|---|---|
| 1,841,100 | 1/1932 | Faber | 366/34 |
| 1,923,151 | 8/1933 | Koehring | 366/15 |
| 2,015,488 | 9/1935 | Manabe | 366/15 |
| 2,703,703 | 3/1955 | Nargelovic | 366/15 |
| 3,580,551 | 5/1971 | Speyerdorf | 366/15 |

FOREIGN PATENT DOCUMENTS

| | | | |
|---|---|---|---|
| 135145 | 5/1947 | Australia | 366/156 |
| 975637 | 11/1964 | United Kingdom | 366/15 |

*Primary Examiner*—Philip R. Coe
*Assistant Examiner*—Thomas W. Epting
*Attorney, Agent, or Firm*—Wenderoth, Lind & Ponack

[57] ABSTRACT

A method for producing concrete in a multi-layer pan type mixer comprising upper and lower mixers having upper and lower mixing tanks driven by separate motors and a discharge gate communicating the upper mixing tank with the lower mixing tank, said method comprising supplying sand, cement and primary mixing water to the upper mixing tank and performing primary mixing therein to obtain a mortar, discharging the mortar into the lower mixing tank, simultaneously supplying gravel and secondary mixing water to the lower mixing tank to disperse the gravel into the mortar, and performing secondary mixing therein.

6 Claims, 9 Drawing Figures

A : Comparative Example No. 1
B : Comparative Example No. 2
C : Example No. 1 of the present Invention
D : Example No. 2 of the present Invention A : Comparative Example No. 3
B : Comparative Example No. 4
C : Example No. 3 of the present Invention
D : Example No. 4 of the present Invention

METHOD FOR PREPARING CONCRETE BY USE OF MULTI-LAYER PAN TYPE MIXER

BACKGROUND OF THE INVENTION

The present invention relates to improvements in and of the method for preparing concrete by use of a multi-layer pan type mixer as disclosed by the present inventors in Japanese Patent Publication No. Sho 53-31167 (hereinafter called the earlier invention).

According to the earlier invention, a multi-layer pan type mixer is used, which comprises upper and lower mixing tanks having their main shafts connected to each other directly or through an intermediate transmission device, a single motor for driving both the upper and lower mixing tanks, and a discharge gate communicating between the upper tank and the lower mixing tanks. Sand, cement and water are successively fed into the upper mixing tank to perform primary mixing to obtain a mortar, and the mortar thus obtained is discharged into the lower mixing tank. At the same time, gravel is fed into the lower mixing tank to be dispersed in the mortar, whereafter secondary mixing is performed.

According to this earlier invention, remarkable advantages are obtained in that high-quality concrete can be prepared and the efficiency of the mixer can be improved. On the other hand, since all of the mixing water is supplied to the mixing tank of the upper mixer, and no secondary mixing water is supplied to the mixing tank of the lower mixer, this prior art has the disadvantages mentioned below.

In the practical preparation of concrete, the mixing proportions of the materials and the amount of mixing water, are adjusted so as to obtain ready-mixed concrete of various types as required for various kinds of secondary concrete products. In the earlier invention, when a concrete of the desired properties is made by adjusting the amount of mixing water and other materials, all of the mixing water is fed into the mixing tank of the upper mixer. Therefore, in a case where the amount of mixing water is large, the friction among the mortar materials becomes so small that satisfactory mixing cannot be achieved. Therefore, in the earlier invention, it is necessary to use a mixing adjusting means for increasing the rate of rotation of the mixer or to modify the shape of the mixing blades so as to enhance the mixing efficiency.

SUMMARY OF THE INVENTION

In order to overcome the disadvantages of the prior art mentioned above, the present inventors have made extensive studies and experiments in order to develop a new multi-layer pan type mixer usable for preparation of various mortars irrespective of the amount of mixing water to be used and without using a mixing adjusting means, and have found that no matter what type of ready-mixed concrete is to be prepared (i.e. no matter what consistency the ready-mixed concrete to be discharged from the mixing tank of the lower mixer is to have), the mortar materials in the mixing tank of the upper mixer should always by mixed to about the same consistency. The present invention is based on this discovery.

The basic feature of the present invention is that part of the total amount of mixing water is introduced as primary mixing water to the mixing tank of the upper mixer so as to obtain by the primary mixing a mortar of consistency which is approximately the same regardless of the type of ready-mixed concrete to be prepared, and the remainder of the mixing water is introduced as secondary mixing water to the mixing tank of the lower mixer. Therefore, the consistency of the mortar mixed in the upper mixer is always about the same. As a result, the final ready-mixed concrete is of improved quality and the time required for mortar mixing is both reduced and made constant, much facilitating cycle time programming of the mixer wherein second-order timing is critical. Moreover, the mixing adjusting means required by the conventional mixers can be omitted, and, as will be explained hereinafter, the effects obtained by delayed addition of water-reducing admixture are markedly enhanced. A further advantage is that the inside of the mixing tank of the lower mixer can be washed with the secondary mixing water.

On the other hand, however, it has been found that adoption of the aforesaid feature gives rise to the following problems. First, although the water content of the mortar is less than in prior art so that the mortar has lower fluidity and greater friction among its materials and can therefore be adequately mixed at a low rate of rotation, lowering the rate of rotation too far will make it necessary to increase the mixing time.

Second, the rate of rotation of the upper mixer must be maintained at an appropriate level so as to maintain a balance between the mixing times, the material measuring times and the material charging and discharging times of the upper and lower mixing tanks since this balance determines the efficiency of a multi-layer pan type mixer as a whole. As a result, the driving power of the upper mixer must be maintained relatively large. However, in the case of the prior art in which the main shafts of the upper and lower mixers are connected by an intermediate power transmission device, and are commonly driven by one driving motor provided on the lower side of the bottom of the mixing tank of the lower mixer, an increase in the driving power tends to cause the following problems: (1) the main shaft and the bearing of the upper mixer must be reinforced proportional to the increase in driving power, and (2) the main shaft and the bearing of the lower mixer, which does not require the increase driving power, must also be reinforced solely because the main shaft of the lower mixer functions as an intermediate shaft for the upper mixer.

The above-mentioned disadvantages can be overcome by a structure in which the upper and lower mixers are independently driven by separate driving motors so as to reduce the need for structural reinforcement due to the increased driving power for the upper mixer.

Generally speaking, when cement particles are mixed with water, some of the cement particles coagulate to form flocks. However, when a water-reducing admixture is used, the cement particles are electrostatically activated and repel each other. The particles thus separate to form a dispersion. This dispersion liberates water and air from the flocks, thus increasing the flowability of the cement slurry and improving the workability of the concrete.

Further, if the addition of the water-reducing admixture is delayed, namely, if it is added after the addition of the mixing water instead of together with the mixing water, its water-reducing effect is even further improved.

The water-reducing admixture is usually added at the rate of about 0.25% relative to the cement, and in order to assure its uniform mixture with the cement, all or part of the admixture is first mixed with the mixing water and then added to the cement.

In the case of the earlier invention, when a water-reducing admixture is to be added, it is added to the upper mixer because the whole amount of mixing water is added thereto. Further, since the mixing time is the upper mixer is very short (22 seconds, for example), delayed addition of the admixture is quite difficult.

In the present invention, the mixing water is dividedly supplied as primary mixing water and secondary mixing water, and according to a first modification of the present invention, the water-reducing admixture is added to the lower mixer together with the secondary mixing water. The water-reducing effect obtained by this arrangement is far greater than that obtained by the delayed addition of water-reducing admixture to a single-tank type mixer as illustrated by the examples set forth hereinafter.

The remarkable difference in the water-reducing effect can be attributed to the fact that in the case of the delayed addition of water-reducing admixture to the single tank type mixer, when the diluted water-reducing admixture is poured onto the surface of concrete composed of sand, gravel, cement and water under mixing, the water-reducing admixture floats on the concrete surface and cannot be uniformly mixed into the concrete in a short time.

According to the present invention, the upper mixer serves only for mixing mortar, and when mortar which has been thoroughly mixed by the upper mixer is discharged into the lower mixer, the secondary water mixed with gravel and water-reducing admixture is simultaneously fed into the lower mixer so that the mortar and the gravel are fully mixed. In this way, the above problem is solved in the present invention.

According to a second modification of the present invention, it is possible to introduce a measured amount of secondary mixing water into the lower mixer efficiently using only a single water metering device.

According to the present invention, both the primary water measuring tank and the secondary water measuring tank may be connected to a single water metering device, and be directly connected to the upper mixer and lower mixer respectively so as to supply the primary mixing water and the secondary mixing water to the respective tanks. In this case, the secondary mixing water is once measured in the secondary water measuring tank and then temporarily stored therein before being introduced into the lower mixer.

Without this modification, the cycle time between the time when the measured materials are charged into the mixer and the time when the resultant concrete is discharged from the gate after the primary and secondary mixing is completed is as long as 57 seconds. This is because the measurement of the water amount from the second batch is delayed until the gravel is measured. On the other hand, with this second modification, the secondary water is transferred to the secondary water pooling tank immediately after the measurement. The secondary water measuring tank is thus empty and ready for measurement of the subsequent batch so that the cycle time is shortened to about 42 seconds, thus greatly improving the production efficiency.

In a third modification of the present invention, the water-reducing admixture is added to the secondary water with no delay in the cycle time. Therefore, the function of the secondary water pooling tank is the same as in the second modification.

When the primary water and the secondary water are supplied using two water metering devices and two water measuring tanks, the secondary water pooling tank is not necessary. But the use of two water metering devices is uneconomical and requires increased floor area.

Description will be made hereinafter regarding the fourth and fifth modifications.

During the mixing of concrete in a mixer, cement and pulverized stone stick to the inside wall of the mixing tank, the mixing arm and the blades, etc. and accumulate thereon to lower the mixing capacity and efficiency, ultimately preventing mixing altogether. As a countermeasure, the operation must often be stopped to wash the inside of the mixing tank with a large amount of water, and at the end of every operation, the solid adhesions on the inside wall of the tank must be scraped off.

In order to solve the above problem, the present inventors previously proposed a washing device suitable for a single-tank type mixer, as disclosed in Japanese Utility Model Publication No. Sho 55-42874. This washing device comprises a receiving tank provided below a measuring tank, a slurry pump arranged in the receiving tank, a washing pipe connected at its one end to the outlet side of the slurry pump, a projection pipe connected to the other end of the slurry pump and opening into the mixer, a residual water pipe having an adjusting valve and connected at its end to the bottom opening of the receiving tank, and a spray pipe connected to the other end of the residual water pipe. This device utilizes the mixing water after measurement as the washing water.

In the earlier invention mentioned at the beginning of this specification, the whole amount of the measured mixing water is introduced into the upper mixer, and no secondary mixing water is supplied to the lower mixer, so that in order to wash the lower mixer which is far more susceptible to adhesion of material on its inside wall than the upper mixer, it is necessary to stop the operation and wash the tank with water supplied from a separate source, thus lowering productivity, making it necessary to provide additional equipment for treating the used water, and complicating the structure of the mixer.

Therefore, in order to overcome these drawbacks of the earlier invention, the fact that in the present invention mixing water is supplied to both the upper and lower mixers is used to advantage in a fourth modification wherein the washing device described above is incorporated to use the secondary water to wash the lower mixer and in a fifth modification wherein the washing device is incorporated not only to use the secondary water to wash the lower mixer but also to use the primary water to wash the upper mixer.

Further objects and features of the invention will be clear from the following detailed description made with reference to the attached drawings.

DESCRIPTION OF PREFERRED EMBODIMENTS

Figure 1:
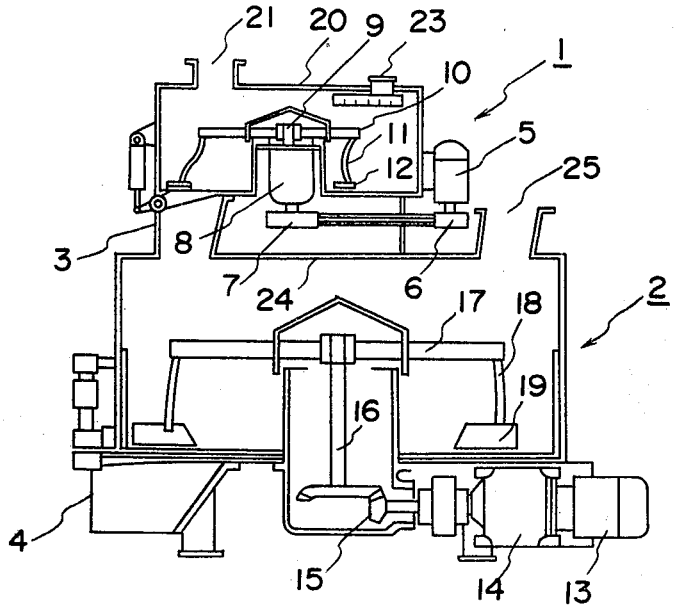
FIG. 1 is a schematic view showing a multi-layer pan type mixer used in the present invention.
Figure 2:
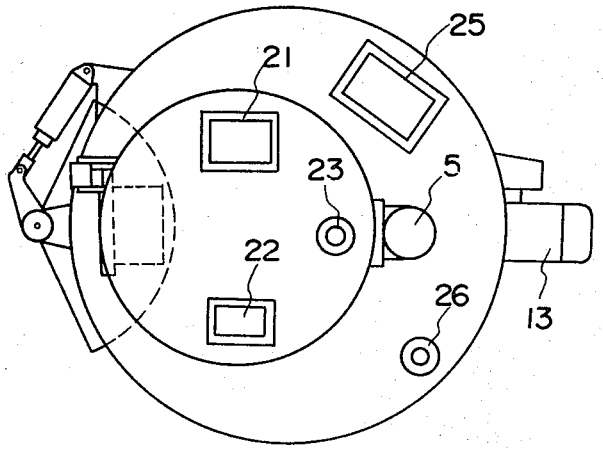
FIG. 2 is a plan view of the mixer shown in FIG. 1.
Figure 3:
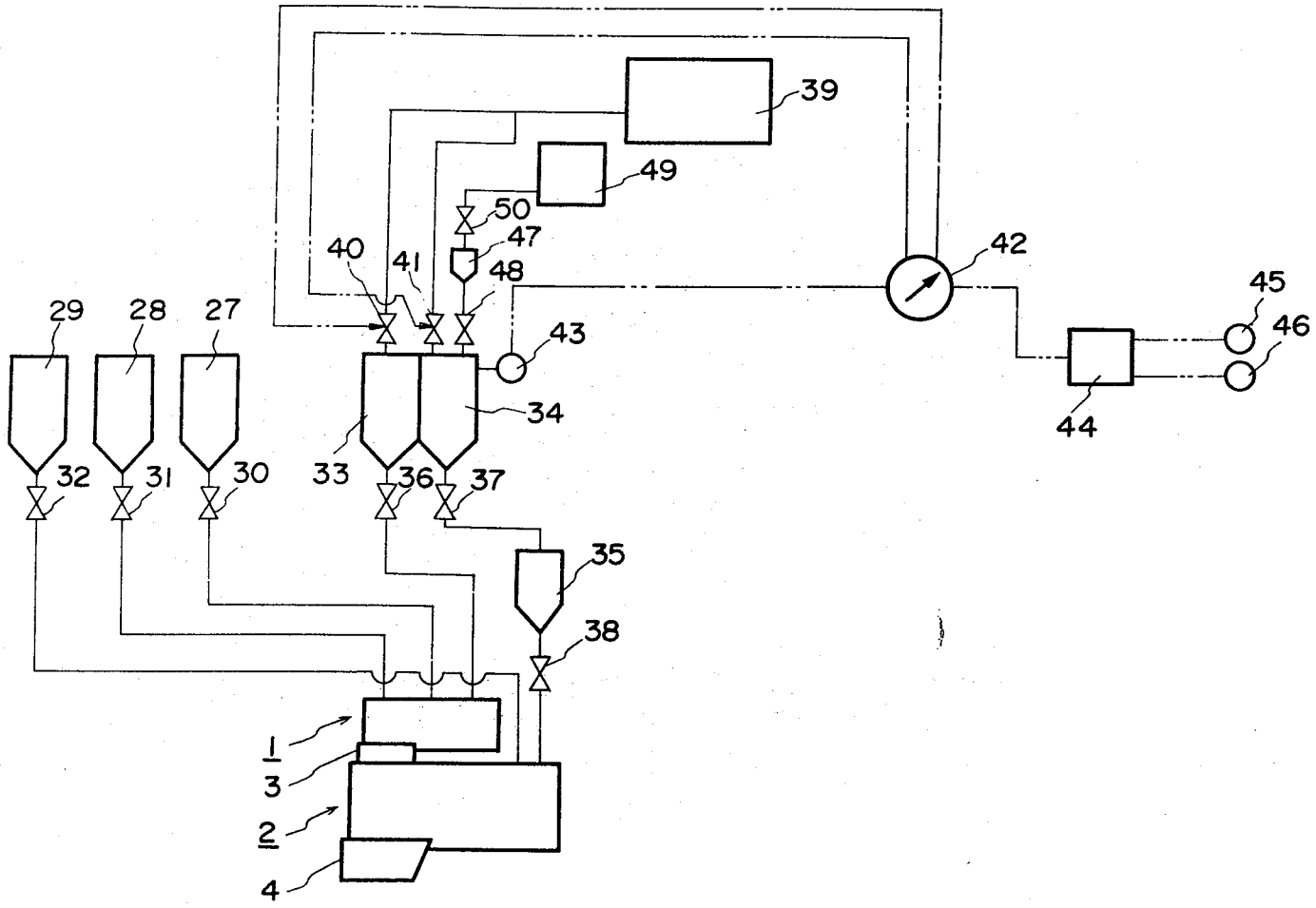
FIG. 3 is a diagram illustrating the system for addition of primary and secondary mixing water according to one embodiment of the present invention.

Referring first to FIGS. 1 to 3, the mixing tank 1 of an upper mixer for primary mixing is arranged over the mixing tank 2 of a lower mixer for secondary mixing and the mixing tank 1 is provided at its bottom with a discharge gate 3 for transferring the mortar to the lower mixer and the mixing tank 2 of the lower mixer is provided at its bottom with a discharge gate 4 for discharging the concrete obtained by the secondary mixing. In the upper mixer, the driving power from a motor 5 is transmitted through the pulleys 6 and 7 and a reduction gear 8 to a main shaft 9.

In the mixing tank 1 of the upper mixer, a rotor 10 is fixed to the main shaft 9 and an arm 11 is extended from the rotor 10. At the lower end of the arm 11 is attached a blade 12 which is rotated together with the arm.

In the lower mixer, the driving force from a motor 13 is transmitted through reduction gears 14 and 15 to a main shaft 16. In the mixing tank 2, a rotor 17 having an arm 18 is fixed to the main shaft 16, and a blade 19 is attached to the lower end of the arm and rotated together with the arm. A lid 20 having charging openings 21, 22 and 23 is provided on the top portion of the mixing tank 1 of the upper mixer, while on the top portion of the mixing tank of the lower mixer a lid 24 having charging openings 25 and 26 is provided.

In FIG. 3, a sand measuring tank 27 and a cement measuring tank 28 each connected to a metering machine (not shown) communicate with the charging openings 21 and 22 of the mixing tank of the upper mixer through pipes having discharge valves 30, 31. A gravel measuring tank 29 is connected with the charging opening 25 of the mixing tank 2 of the lower mixer via a pipe having a discharge valve 32. The water measuring tank consists of a primary water measuring tank 33 and a secondary water measuring tank 34, the primary water measuring tank 33 being connected to the charging opening 23 of the mixing tank 1 of the upper mixer through a pipe having a discharge valve 36, and the secondary water measuring tank 34 being connected to a secondary water pooling tank 35 through a pipe having a discharge valve 37, and the secondary water pooling tank 35 is connected to the charging opening 26 of the mixing tank 2 of the lower mixer through a pipe having a discharge valve 38. A water pooling tank 39 is connected to the primary water measuring tank 33 by a pipe having an automatic valve 40 and to the secondary water measuring tank 34 by a pipe having an automatic valve 41. A water metering device 42 is electrically connected to the automatic valves 40 and 41 for metering the primary and secondary water, as well as to a transducer 43 and an operation circuit 44, which is in turn electrically connected to a water setter 45 and a secondary water setter 46.

A water-reducing admixture measuring tank 47 connected to a metering device (not shown) is connected to the secondary water measuring tank 34 by a pipe having a discharge valve 48, and a water-reducing admixture storing tank 49 is connected to the water-reducing admixture measuring tank 47 by a pipe having an automatic valve 50.

Figure 5:
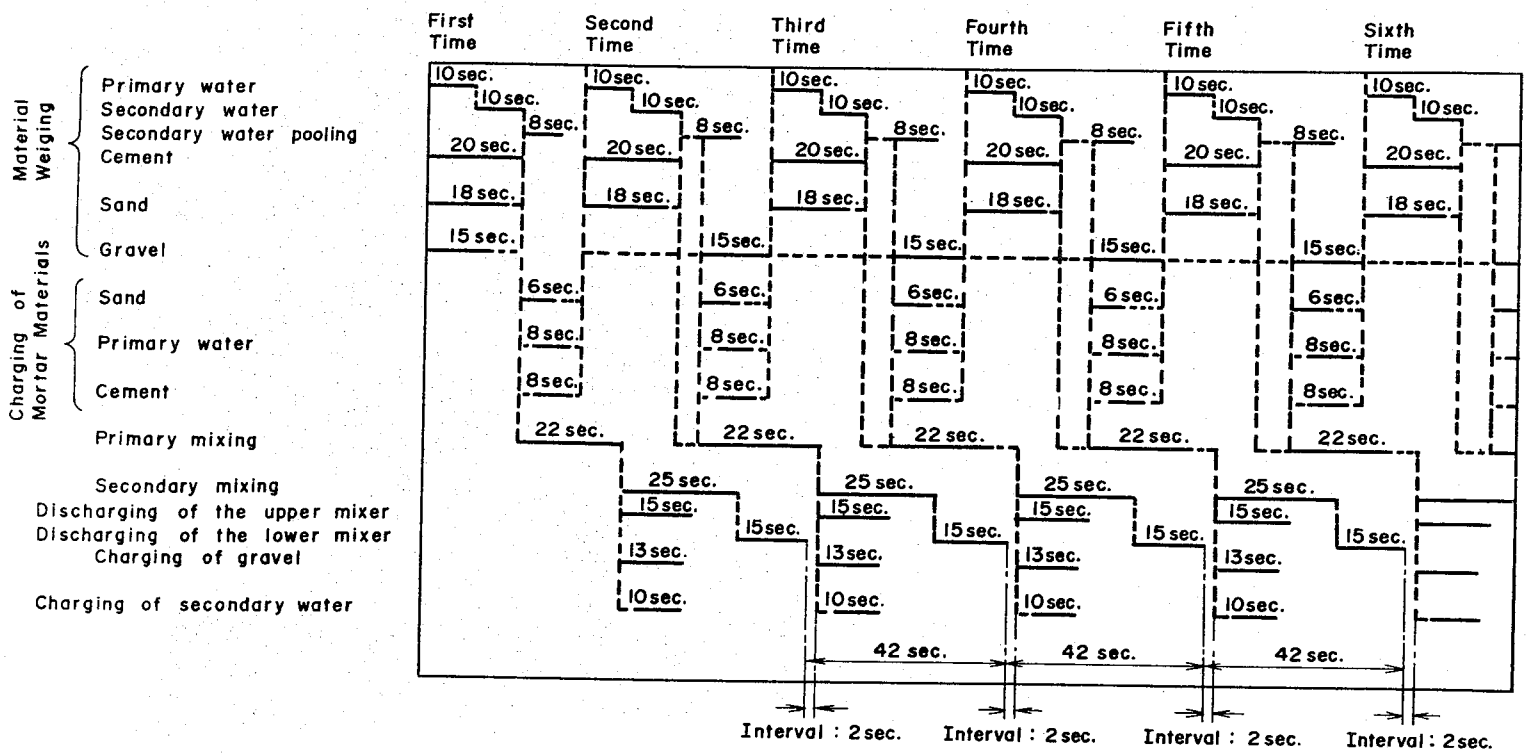
FIG. 5 is a cycle time schedule for an embodiment with a secondary water pooling tank.

The preparation of concrete in the mixer of the construction described above will now be explained with reference to the second batch (time) shown in FIG. 5. Required amounts of primary water, secondary water, cement and sand are first measured, and the primary water, cement and sand for preparing the mortar are supplied to the mixing tank 1 of the upper mixer. Simultaneously with the commencement of the primary mixing, the secondary water is transferred from the secondary water measuring tank 34 to the secondary water pooling tank 35. The gravel is also measured. Subsequently, measurement of the primary water, secondary water, cement and sand is started for the next batch. The mortar obtained by the primary mixing is poured through the discharge gate 3 into the mixing tank 2 of the lower mixer which is simultaneously supplied with gravel and secondary water. These materials are subjected to secondary mixing and discharged out of the mixer through the discharge gate 4. The primary mixing of the next batch is started in the course of the secondary mixing of the preceding batch and is completed simultaneously as the concrete of the preceding batch is completely discharged out of the mixing tank 2 of the lower mixer following completion of its secondary mixing. The mortar of the next batch is then poured into the mixing tank 2 of the lower mixer and subjected to the secondary mixing with additionally supplied secondary water and gravel.

Figure 6:
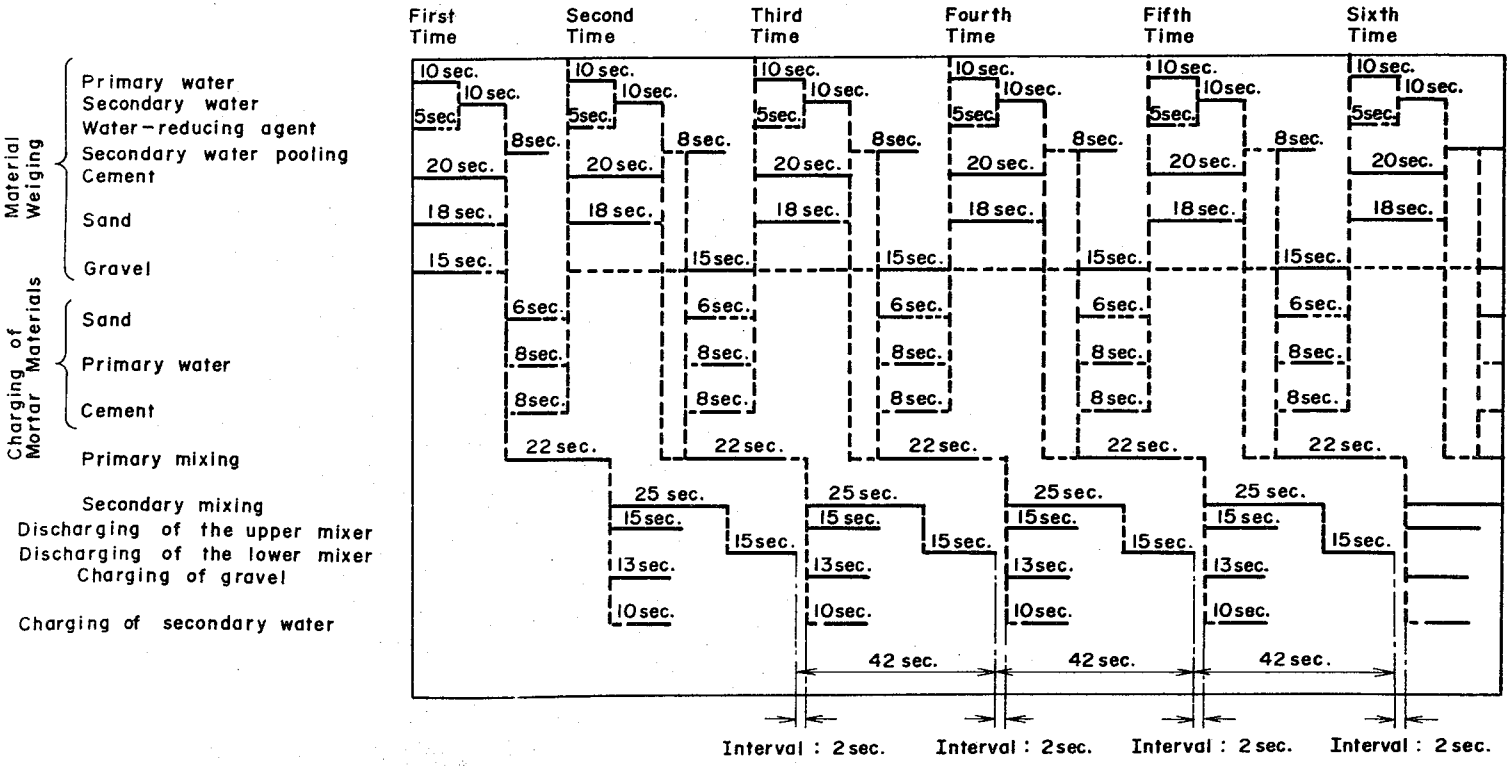
FIG. 6 is a cycle time schedule for an embodiment with a secondary water pooling tank wherein water-reducing admixture is added to the secondary water.

Next, the case in which a water-reducing admixture is added to the concrete will be described in conjunction with the second batch (time) shown in FIG. 6. Required amounts of primary water, water-reducing admixture and cement are first measured out. The metering of the secondary water is begun after completion of the metering of the primary water and the water-reducing admixture. The water-reducing admixture can be supplied either in accordance with an advance metering method wherein its transfer to the secondary water measuring tank 34 is completed by the time the metering of the secondary water is completed or in accordance with another method wherein it is supplied directly to the secondary water pooling tank 35 simultaneously with the secondary water.

Next the primary water, cement and sand for preparing the mortar are supplied to the mixing tank 1 of the upper mixer and the primary mixing begins immediately. Simultaneously with the initiation of the primary mixing, the metered amounts of the water-reducing admixture and the secondary water are transferred to the secondary water pooling tank 35. The gravel is also measured. At this time metering of the primary water, water-reducing admixture, secondary water, cement and sand for the next batch is begun. The mortar obtained by the primary mixing is poured through the discharge gate 3 into the mixing tank 2 of the lower mixer which is simultaneously supplied with gravel and secondary water mixed with water-reducing admixture. These materials are subjected to secondary mixing and discharged out of the mixer through the discharge gate 4. The primary mixing of the next batch is started in the course of the secondary mixing of the preceding batch and is completed simultaneously as the concrete of the preceding batch is completely discharged out of the mixing tank 2 of the lower mixer following completion of its secondary mixing. The mortar of the next batch is then poured into the mixing tank 2 of the lower mixer and subjected to the secondary mixing with additionally supplied gravel and secondary water mixed with water-reducing admixture.

The water supply operation in the above described concrete mixing operation will be described in more detail.

Mortar having an appropriate flow value is obtained by setting the water setter 45 to the total amount of water required in mixing the concrete and setting the primary water setter 46 to the amount of primary water required. This causes the automatic valve 40 for metering primary water to open and allow water to pass from the water pooling tank 39 to the secondary water measuring tank 34. When the amount of water flowing into the secondary water measuring tank 34 reaches the set value, the valve 40 is made to close by a measurement completion signal, thus completing this measurement operation.

The amount of secondary water, namely the total amount of water minus the amount of primary water, is automatically calculated by the operation circuit 44 which operates the automatic valve 41 immediately after completion of the measurement of primary water so as to allow secondary water to pass into the secondary water measuring tank 34. When the amount of secondary water which has passed into the secondary water measuring tank 34 reaches the calculated amount, the operation circuit 44 issues a completion signal to close the automatic valve 41, thus completing the metering of secondary water.

Regarding the water supply operation in the case where the water-reducing admixture is added to the concrete, the amount of the secondary water including the diluting water in the water-reducing admixture is automatically calculated by the operation circuit 44 by subtracting the amount of the primary water from the total water amount so that after completion of the primary water measurement, the automatic valve 41 for the secondary water measurement is actuated and simultaneously the discharge valve 48 for the water-reducing admixture is also actuated to transfer the water-reducing admixture to the secondary water measuring tank 34 before the completion of the secondary water measurement, and after the remaining secondary water has been supplied to the secondary water measuring tank 34, the automatic valve 41 closes in response to the measurement completion signal to complete the measurement.

Figure 4:
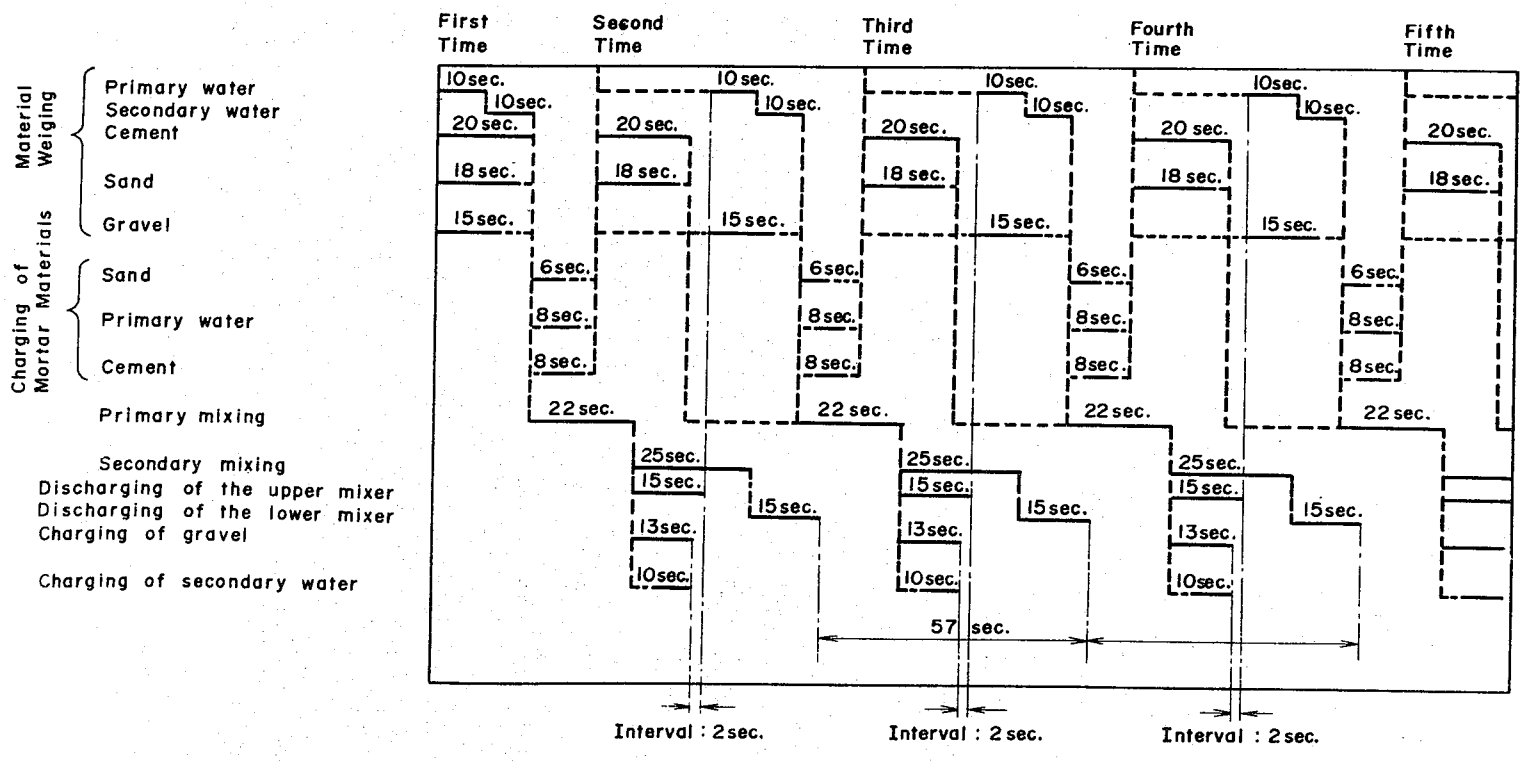
FIG. 4 is a cycle timing schedule for an embodiment of the present invention without a secondary water pooling tank.

The primary water measured into the primary water measuring tank 33 is supplied to the mixing tank together with the other mortar materials when the discharge valve 36 is opened. The primary water measuring tank 33 is then empty and ready for measuring the subsequent batch. By opening the discharge valve 37, the secondary water measured into the secondary water measuring tank 34 is passed to the secondary water pooling tank 35 where it is stored temporarily. The secondary water measuring tank is in this way emptied and made ready for the measurement of the subsequent batch almost simultaneously with the emptying of primary water measuring tank 33. In the present invention, in which both the primary water and the secondary water are measured by a single water metering device, the measuring tanks for the primary water and the secondary water must be empty before the measurement of the primary and secondary water can be effected. Therefore, if no secondary water pooling tank is provided, the secondary water in the secondary water measuring tank 34 cannot be discharged until the secondary mixing of the batch is started so that the measurement of the primary water for the subsequent batch is delayed and, as shown in FIG. 4, the cycle time for successive batches is prolonged. For this reason, the provision of the secondary water pooling tank 35 produces a remarkable advantage in terms of the cycle time.

Figure 7:
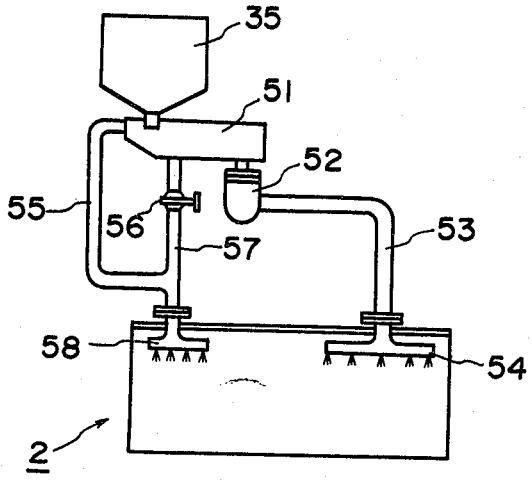
FIG. 7 is a schematic view showing a washing device for washing the mixing tanks using the secondary and primary water.

Next, a washing device for washing the mixing tanks using the secondary water and the primary water will be described with reference to FIG. 7.

The washing device disclosed in Japanese Utility Model Publication No. Sho 55-42874 was developed mainly for use in washing a single tank type mixer, but its basic structure can be fully utilized for use in washing a multi-layer pan type mixer. As a washing device for washing the mixing tank 2 of the lower mixer with secondary water, a receiving tank 51 with a slurry pump 52 is provided below the secondary water pooling tank 35. One end of a washing pipe 53 is connected to the outlet side of the slurry pump 52 and its other end is connected to a spray pipe 54 opening to the inside of the mixing tank 2 of the lower mixer. A water discharge pipe 55 is connected at its one end to the upper portion of the receiving tank 51 and at its other end to a residual water pipe 57 having an adjusting valve 56 extending from the bottom of the receiving tank 51 and communicating with a sprinkler pipe 58 opening in the inside of the mixing tank 2 of the lower mixer.

With the above arrangement, the secondary water is supplied to the secondary water pooling tank 35 and discharged into the receiving tank 51 through a bottom opening. In this case, an excessive amount of water is discharged at one time and the surplus is discharged into the mixing tank 2 of the lower mixer through the water discharge pipe 55 and the sprinkler pipe 58. On the other hand, the slurry pump 52 suspended from the receiving tank 51 is rotated to draw in the secondary water and force it through the washing pipe 53 so as to jet out from a plurality of jet holes in the spray pipe 54. Most of the secondary water is used in this way to provide a forced jet spray onto the inside wall of the mixing tank, the mixing arm and blades during the mixing operation. In this way, adhering material is removed and its accumulation prevented during the operation of mixing the materials with water.

Simultaneously, part of the secondary water flows through the adjusting valve 56 of the residual water pipe 57 communicating with the bottom of the receiving tank and is sprinkled onto the materials being mixed in the mixing tank 2 of the lower mixer through a plurality of spray holes in the sprinkler pipe 58.

The residual water pipe 57 is provided with an adjusting valve 56 for controlling the flow rate. All secondary water remaining in the receiving tank 51 is completely discharged through this course.

The structure for and operation of the means for washing the mixing tank 1 of the upper mixer with the primary water is identical to that for the lower mixer except that primary water is used instead of secondary water, the upper mixer is washed instead of the lower mixer and the water for washing is obtained from the primary water measuring tank 33 instead of the secondary water pooling tank 35.

Figure 8:
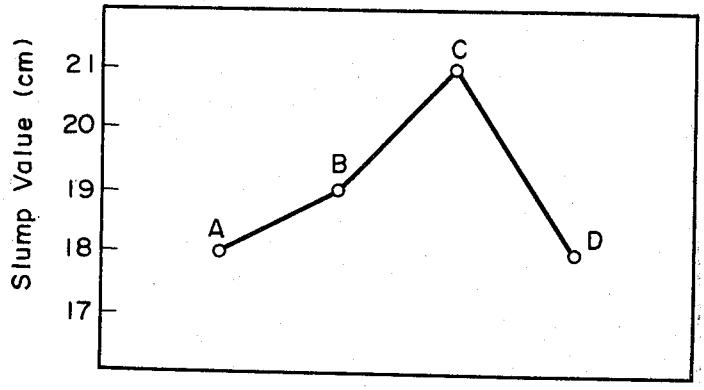
FIGS. 8 and 9 are graphs showing the slump values in the embodiments of the present invention and in comparative examples.
Figure 9:
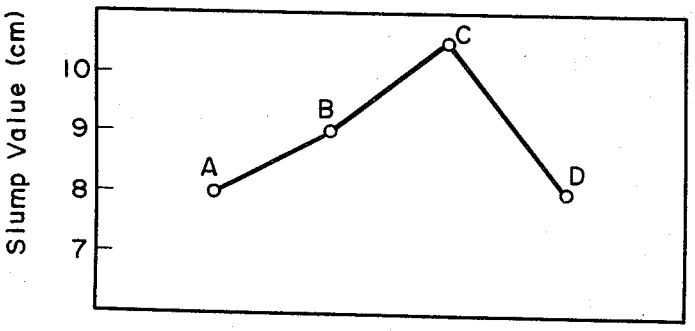

The advantages of the first modification of the present invention will be described with reference to Table 1, Table 2, FIG. 8 and FIG. 9 in comparison with comparative examples.

The comparative examples 1 and 3 relate to the earlier invention disclosed in Japanese Patent Publication No. Sho 53-31167 in which the water-reducing admixture is simultaneously added, and the slump values in these comparative examples are 18 cm and 8 cm respectively. The comparative examples 2 and 4 relate to the conventional art using a single-tank pan type mixer in which addition of the water-reducing admixture is delayed. In these comparative examples, the slump value is improved by 1 cm over the comparative examples 1 and 3 for the same mixture proportions.

On the other hand, the slump values in the examples 1 and 3 of the present invention are remarkably improved by 3 cm and 2.5 cm respectively over the comparative examples 1 and 3 for the same mixture proportions.

The examples 2 and 4 illustrate mixture compositions which showed the same slump values as the comparative examples 1 and 3. Thus in order to obtain a concrete having the same slump value as with the invention of Japanese Patent Publication No. Sho 53-31167, it is possible to reduce the combined amount of primary and secondary mixing water by 9 kg/m$^3$ of concrete and 7 kg/m$^3$ of concrete respectively.

Further, in order to maintain the required strength of the concrete, it is common practice to maintain a constant water-cement ratio. If the water-cement ratio is maintained constant in the present invention, then because of the reduction in amount of water, the cement is saved at the rate of 13 kg/m$^3$ of concrete and 12 kg/m$^3$ of concrete. These figures mean 4.4% and 4.8% savings of cement, meaning that the invention provides a significant industrial advantage.

According to another embodiment of the present invention, no sand but only the primary water and cement are supplied to the mixing tank of the upper mixer for primary mixing, and the resultant mixture is poured into the mixing tank of the lower mixer which is simultaneously supplied with sand, gravel and secondary water for carrying out the secondary mixing.

This embodiment may be incorporated in the first, second and third modifications of the present invention, and in all of these cases the concrete can be prepared efficiently as expected by a multi-layer pan type mixer process.

TABLE 1

| No. | Method used |
|---|---|
| Comparative Example 1 | Multi-layer pan type mixer, water-reducing admixture supplied to upper mixer simultaneously with mortar materials. After mixing, resulting mortar, secondary water, and gravel mixed in lower mixer. |
| Comparative Example 2 | Single-tank pan type mixer. All concrete materials mixed for 30 sec followed by delayed addition of water-reducing admixture and further mixing. |
| Example 1 | Multi-layer pan type mixer. Mortar materials supplied to upper mixer. After mixing, resulting mortar, secondary water mixed with water-reducing admixture, and gravel mixed in lower mixer. |
| Example 2 | Same as Example 1 |
| Comparative Example 3 | Same as Comparative Example 1 |
| Comparative Example 4 | Same as Comparative Example 2 |
| Example 3 | Same as Example 1 |
| Example 4 | Same as Example 1 |

TABLE 2

| No. | Composition Symbol | Mixture Composition (kg/m$^3$) Primary water $W_1$ | Secondary water $W_2$ | Water-reducing admixture* | Cement C | Sand S | Gravel G | Water/Cement ratio $W_1 + W_2/C$ (%) | Fine aggregate ratio S/S + G (%) |
|---|---|---|---|---|---|---|---|---|---|
| Comparative Example 1 | 210-18-25 | 118 | 51 | 0.723 | 289 | 902 | 962 | 58.5 | 48.9 |
| Comparative Example 2 | " | " | " | " | " | " | " | " | " |
| Example 1 | " | " | " | " | " | " | " | " | " |
| Example 2 | " | 113 | 48 | 0.690 | 276 | 918 | 978 | " | " |
| Comparative Example 3 | 210-8-25 | 104 | 45 | 0.638 | 255 | 881 | 1065 | " | 45.7 |
| Comparative Example 4 | " | " | " | " | " | " | " | " | " |
| Example 3 | " | " | " | " | " | " | " | " | " |
| Example 4 | " | 99 | 43 | 0.608 | 243 | 892 | 1081 | " | " |

*Remark: POZZOLITH No. 5 LA3 (Trade Name) manufactured by NISSO Builders Co., Ltd. Essential component is lignin-sulfonate.

What is claimed is:

1. A method for producing concrete in a multi-layer pan type mixer comprising upper and lower mixing tanks driven by separate motors and a discharge gate communicating the upper mixing tank with the lower mixing tank, said method comprising supplying sand, cement and primary mixing water into the upper mixing tank to perform primary mixing therein to obtain a mortar, said primary mixing water being in a quantity which is suitable for said primary mixing and necessary to ensure that said mortar has substantially predetermined properties, discharging said mortar into the lower mixing tank, simultaneously supplying gravel and secondary mixing water into the lower mixing tank to disperse the gravel in said mortar, said secondary mixing water being in a quantity which is equal to the quantity of water required to obtain desired properties, less that quantity primary mixing water introduced into the upper mixing tank, and performing secondary mixing in the lower mixing tank.

2. A method according to claim 1, in which a water-reducing admixture is added to the secondary mixing water before it is supplied to the lower mixing tank.

3. A method according to claim 1, in which the primary mixing water is metered into a primary water measuring tank and the secondary mixing water is metered into a secondary mixing water measuring tank, the metering of the water into both tanks being performed by a single metering device, and the primary mixing water is supplied to the upper mixing tank while the secondary mixing water is once pooled in a secondary water pooling tank and then supplied to the lower mixing tank.

4. A method according to claim 3, in which a water-reducing admixture is added to the secondary mixing water before it is pooled in the secondary water pooling tank.

5. A method according to any of claims 1, 2, 3 or 4, in which the secondary mixing water is used for washing the inside of the lower mixing tank.

6. A method according to any of claims 1, 2, 3 or 4, in which the primary mixing water is used for washing the inside of the upper mixing tank and the secondary mixing water is used for washing the inside of the lower mixing tank.

* * * * *